US008585365B1

(12) United States Patent
Liang

(10) Patent No.: US 8,585,365 B1
(45) Date of Patent: Nov. 19, 2013

(54) TURBINE BLADE WITH TRIPLE PASS SERPENTINE COOLING

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 890 days.

(21) Appl. No.: 12/758,915

(22) Filed: Apr. 13, 2010

(51) Int. Cl.
*F01D 5/18* (2006.01)

(52) U.S. Cl.
USPC ..... 416/97 R

(58) Field of Classification Search
USPC ..... 415/115; 416/97 R
See application file for complete search history.

(56) References Cited

U.S. PATENT DOCUMENTS 5,813,835 A * 9/1998 Corsmeier et al. ..... 416/97 R
6,056,508 A * 5/2000 Johnson et al. ..... 416/96 R
6,773,231 B2 * 8/2004 Bunker et al. ..... 416/97 R
7,097,426 B2 * 8/2006 Lee et al. ..... 416/97 R
7,442,008 B2 * 10/2008 Kopmels et al. ..... 416/97 R
7,513,744 B2 * 4/2009 Cunha et al. ..... 416/92
7,674,092 B2 * 3/2010 Annerfeldt et al. ..... 416/97 R

* cited by examiner

*Primary Examiner* — Ninh H Nguyen
(74) *Attorney, Agent, or Firm* — John Ryznic

(57) ABSTRACT

A turbine rotor blade with a dual triple pass serpentine flow cooling circuit in which a first triple pass serpentine circuit flows along the pressure side wall and the second triple pass serpentine circuit flows along the suction side wall to provide near wall cooling to the two walls. The legs of the serpentine flow cooling circuits have slanted ribs that form diamond shaped mixing chambers such that a criss-cross flow path for the cooling air is formed. In one embodiment, the last leg of the first serpentine circuit provides cooling to the leading edge region with showerhead film holes while the last leg of the second serpentine provides cooling to the trailing edge region with a row of exit holes. In other embodiments, the two serpentine circuits flow in a forward or a rearward direction with two trailing edge cooling channels arranged in the trailing edge and with a separate leading edge cooling supply channel to provide cooling air form the leading edge region.

22 Claims, 6 Drawing Sheets

TURBINE BLADE WITH TRIPLE PASS SERPENTINE COOLING

GOVERNMENT LICENSE RIGHTS

None.

CROSS-REFERENCE TO RELATED APPLICATIONS

None.

BACKGROUND OF THE INVENTION

1. Field of the Invention

The present invention relates generally to a gas turbine engine, and more specifically to an air cooled turbine rotor blade in a gas turbine engine.

2. Description of the Related Art Including Information Disclosed Under 37 CFR 1.97 and 1.98

In a gas turbine engine, such as a large frame heavy-duty industrial gas turbine (IGT) engine, a hot gas stream generated in a combustor is passed through a turbine to produce mechanical work. The turbine includes one or more rows or stages of stator vanes and rotor blades that react with the hot gas stream in a progressively decreasing temperature. The efficiency of the turbine—and therefore the engine—can be increased by passing a higher temperature gas stream into the turbine. However, the turbine inlet temperature is limited to the material properties of the turbine, especially the first stage vanes and blades, and an amount of cooling capability for these first stage airfoils.

The first stage rotor blade and stator vanes are exposed to the highest gas stream temperatures, with the temperature gradually decreasing as the gas stream passes through the turbine stages. The first and second stage airfoils (blades and vanes) must be cooled by passing cooling air through internal cooling passages and discharging the cooling air through film cooling holes to provide a blanket layer of cooling air to protect the hot metal surface from the hot gas stream. In engines of the future, it is even anticipated that third stage airfoils will also require cooling such as to prevent erosion and limit creep.

In an industrial gas turbine (IGT) engine, the turbine is designed to withstand the highest turbine inlet temperature that can be operated while allowing for the turbine to run constantly under these conditions for long periods of time. Airfoil cooling is performed so that an airfoil mass average sectional metal temperature does not exceed a certain temperature in order to improve airfoil creep capability for a turbine rotor blade. Creep is when the blade stretches in length due to the high radial stress loads produced from the blade rotating while exposed to the high temperatures. As the metal temperature increases, the metal becomes weaker and can become over-stressed. The gap spacing between the blade tips and the outer shroud must be kept to a minimum to control blade tip leakage. When a blade creep occurs, the gap can become negative such that excessive rubbing will occur.

Prior art airfoil cooling makes use of a triple pass (3-pass) serpentine flow cooling circuit that includes a forward flowing triple pass serpentine circuit 10 and an aft flowing serpentine circuit 20. The forward flowing triple pass serpentine circuit 10 includes a first leg 11, a second leg 12 and a third leg 13 that is connected to the leading edge impingement channel or cavity 15 through a row of metering and impingement holes. The showerhead arrangement of film cooling holes (three film holes) and two gill holes (one of the P/S and another of the S/S) discharge film cooling air from the spent impingement cooling air in the L/E channel 15. The forward flowing circuit 10 normally is designed in conjunction with leading edge backside impingement cooling plus a showerhead arrangement of film cooling holes with pressure side and suction side gill holes to provide cooling for the leading edge region of the blade.

The aft flowing serpentine flow circuit 20 is designed in conjunction with the airfoil trailing edge discharge cooling holes. This type of cooling flow circuit is called a dual triple pass serpentine "warm bridge" cooling design with three legs 21-23 and is shown in FIGS. 1 and 2. No film cooling holes are used along the middle section of the airfoil that discharges film cooling air from the serpentine flow cooling circuit. The "warm bridge" cooling circuit operates as follows. Cooling air flows into the forward flowing serpentine circuit 10 in a first leg 11 towards the blade tip, then turns into a second leg 12 and flows toward the root, and then flows into a third leg 13 toward the blade tip, where the third leg 13 is adjacent to the leading edge impingement cavity 15 so that cooling air is bled off through a row of metering and impingement holes to produce impingement cooling against the leading edge wall, in which the spent impingement cooling air then flows out through the showerhead film cooling holes. The aft end side of the blade is cooled with an aft flowing triple pass serpentine circuit 20 and flows through the three legs 21-23 in which the third leg 23 is located adjacent to the trailing edge region. The cooling air from the third leg 23 flows through trailing edge exit holes to cool the trailing edge region.

An alternative prior art cooling design to that of FIGS. 1 and 2 utilizes the dual triple pass serpentine flow circuits for a high operating gas temperature and is shown in FIGS. 3 and 4. The FIGS. 3 and 4 blade cooling circuit is called a "cold bridge" cooling design. In this "cold bridge" cooling circuit, the leading edge airfoil is cooled with a self-contained flow circuit 31. The airfoil mid-chord section is cooled with a triple pass serpentine flow circuit 32. The trailing edge region is cooled with a triple-pass forward flowing serpentine cooling circuit 33 that continues toward the mid-chord triple pass serpentine flow circuit 32. However, the aft flow circuit is flowing in a forward direction instead of the aftward direction as in the "warm bridge" design of FIGS. 1 and 2. Again, the aft flowing serpentine flow circuit is designed in conjunction with the airfoil trailing edge discharge cooling holes. FIG. 4 shows a flow diagram for this "cold bridge" cooling circuit which has two forward flowing triple pass serpentine flow circuits 32 and 33 plus a leading edge cooling air supply channel 31 separate from the triple pass serpentine flow circuits that is used for cooling the leading edge region and discharging the film cooling air through the showerhead holes.

In both of these prior art blade serpentine flow cooling circuits, the internal cavities are constructed with internal ribs that extend across the channels and connect the airfoil pressure side and suction side walls. In most cases, the internal cooling cavities are at a low aspect ratio which is subject to high rotational effect on the cooling side heat transfer coefficient. In addition, the low aspect ratio cavity yields a very low internal cooling side convective area ratio to the airfoil hot gas external surface.

BRIEF SUMMARY OF THE INVENTION

A turbine blade for a gas turbine engine, especially for a large frame heavy-duty industrial gas turbine engine, with a multiple layer serpentine flow cooling circuit that optimizes the airfoil mass average sectional metal temperature to improve airfoil creep capability for the blade cooling design.

In a first embodiment, the blade includes a triple-pass forward flowing serpentine flow cooling circuit located on the pressure side wall that includes a leading edge impingement cavity connected to the third leg, and an aft flowing triple-pass serpentine flow cooling circuit located on the suction side wall that includes the third leg located along the trailing edge region to supply cooling air to trailing edge exit holes. The channels or legs of the serpentine circuits are formed with an arrangement of slanted ribs that form a criss-cross flow path for the cooling air.

In a second embodiment, the blade includes a separate leading edge cooling supply channels with a leading edge impingement cavity supplied by metering holes and connected to a showerhead arrangement of film cooling holes with gill holes. The pressure side wall is cooled by a triple-pass forward flowing serpentine circuit and the suction side wall is cooled by a separate triple-pass serpentine flow circuit, where both triple-pass serpentine circuits have first legs located along the trailing edge region and discharge cooling air out through the pressure side wall and the trailing edge of the blade. The serpentine flow channels also include slanted ribs that form a criss-cross flow path for the cooling air.

A third embodiment is similar to the second embodiment except that the two triple-pass serpentine circuits are aft flowing with the third legs located along the trailing edge region and discharging the cooling air out through the pressure side wall and the trailing edge of the blade. As in the other two embodiments, the serpentine channels are formed with an arrangement of slanted ribs that form a criss-cross flow path for the cooling air.

DETAILED DESCRIPTION OF THE INVENTION

Figure 1:
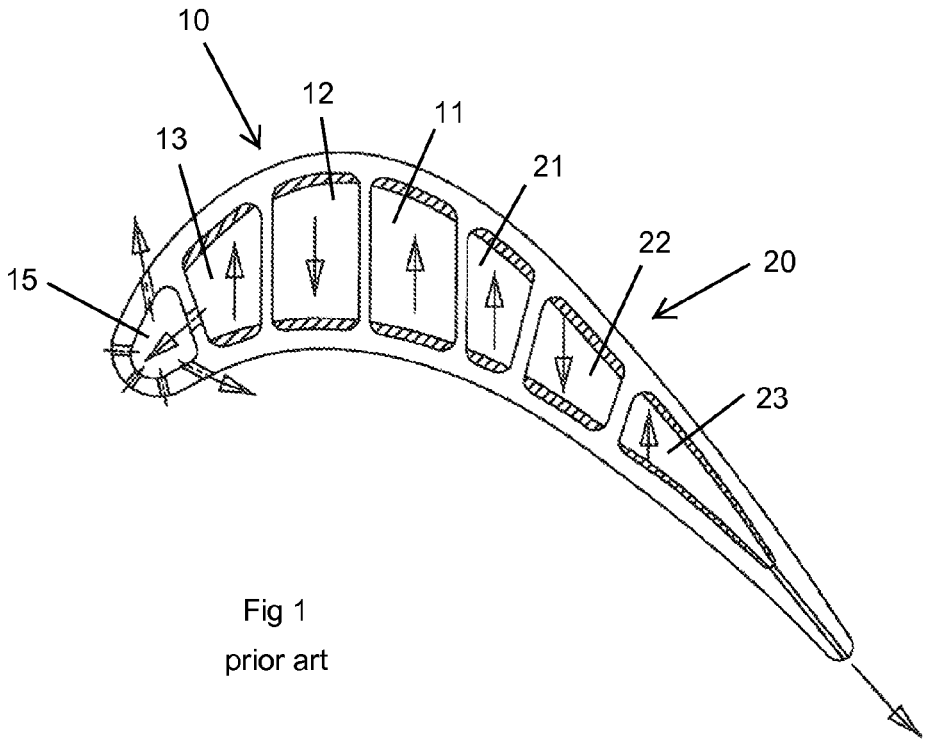
Fig 1 prior art
FIG. 1 shows a cross section view of a dual triple pass serpentine flow cooling circuit of the prior art referred to as a "warm bridge".
Figure 2:
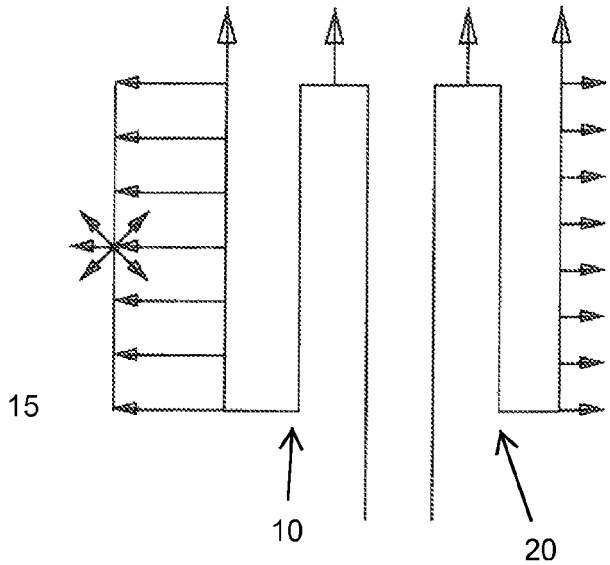
Fig 2 prior art
FIG. 2 shows a flow diagram of the cooling circuit of FIG. 1.
Figure 3:
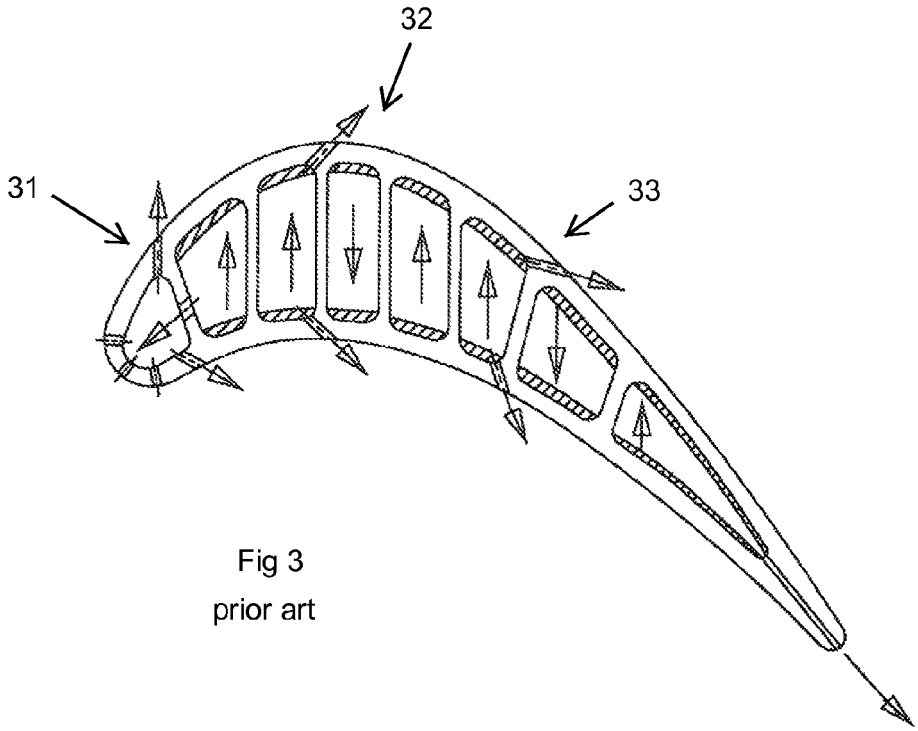
Fig 3 prior art
FIG. 3 shows a cross section view of a dual triple pass serpentine flow cooling circuit of the prior art referred to as a "cold bridge".
Figure 4:
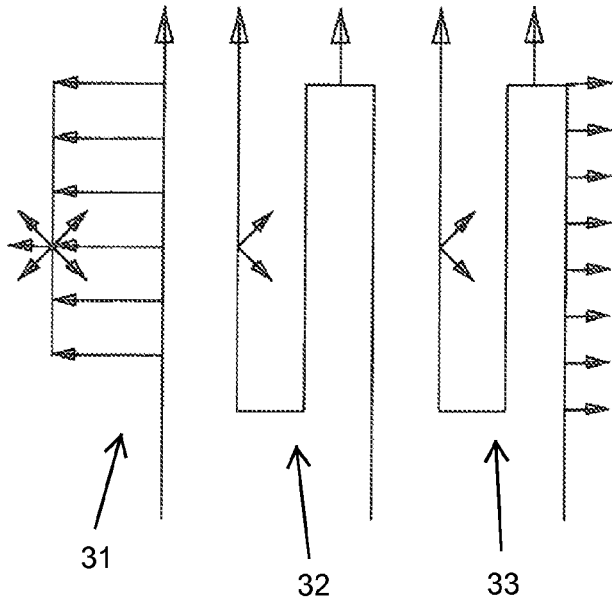
Fig 4 prior art
FIG. 4 shows a flow diagram of the cooling circuit of FIG. 3.
Figure 5:
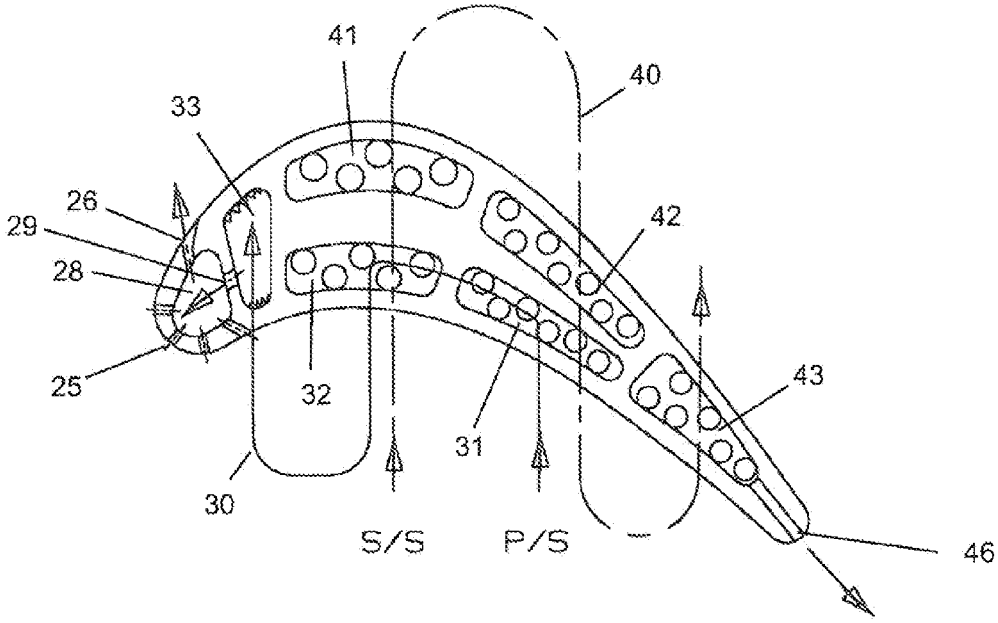
FIG. 5 shows a cross section view of a first embodiment of the dual triple pass serpentine flow cooling circuit of the present invention.

The dual triple pass (3-pass) serpentine flow cooling circuit for the turbine rotor blade of the present invention is shown in FIG. 5 for the first embodiment. The blade includes a first triple pass serpentine flow cooling circuit 30 that flows in a forward direction towards the leading edge and a second triple pass serpentine flow cooling circuit 40 that flows in a rearward (aftward) direction towards the trailing edge. The channels of the two serpentine flow circuits are formed by an arrangement of slanted robs on the P/S and S/S walls of each channel in which the two sets of slanted ribs form a criss-cross flow path for the cooling air.

The first serpentine circuit 30 includes a first leg 31 located adjacent to the trailing edge region and along the pressure side wall and a second leg 32 also along the pressure side wall. The third leg 33 is located adjacent to the leading edge region but extends from the pressure side wall to the suction side wall.

A showerhead arrangement of film cooling holes 26 along with gill holes 27 on the pressure side wall and suction side wall are all connected to a leading edge impingement channel 28 to discharge layers of film cooling air onto the external surface of the leading edge region. A row of metering and impingement holes 29 connect the third leg 33 to the impingement channel 28.

The second triple pass serpentine circuit 40 includes a first leg 41 adjacent to the leading edge region and along the suction side wall, a second leg 42 also along the suction side wall and a third leg 43 located in the trailing edge region of the airfoil that extends across both walls of the airfoil. A row of trailing edge exit cooling holes 46 are connected to the third leg 43.

A leading edge region of the airfoil is the region in which the impingement channel 28 and the third leg 33 is located. The mid-airfoil region is the region in which the first and second legs (31, 32, 41, 42) of both triple pass serpentine circuits 30 and 40 are located. The trailing edge region is where the third leg 43 is located.

Figure 6:
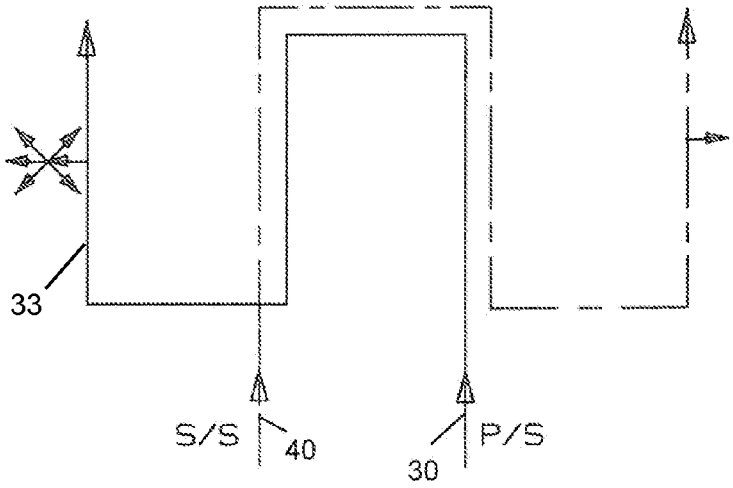
FIG. 6 shows a flow diagram of the cooling circuit of FIG. 5.

FIG. 6 shows a flow diagram for the first embodiment dual triple pass serpentine circuit of FIG. 5. Cooling air supplied to the first leg 31 of the forward flowing first serpentine circuit flows along the pressure side wall and then into the second leg 32 along the pressure side wall to provide near wall cooling to the pressure side wall in this region of the airfoil. The cooling air then flows into the third leg 33 to provide cooling for both pressure side and suction side walls and then through the row of metering holes 29 and into the impingement channel 28 to produce impingement cooling on the backside surface of the leading edge wall of the airfoil. The spent impingement cooling air then flows out through the rows of film cooling holes and gill holes arranged around the leading edge region. The third leg 33 also includes at least one tip hole to discharge some of the cooling air out through the blade tip as represented by the arrow in FIG. 6.

FIG. 6 also shows cooling air supplied to the first leg 41 of the second serpentine circuit 40 that flows up and along the suction side wall to provide near wall cooling to this section, and then into the second leg 42 along the suction side wall, and then into the third leg 43 to provide near wall cooling to both side walls along this trailing edge region. From the third leg 43, the cooling air is discharged through the row of trailing edge exit cooling holes 46 to provide cooling to the trailing edge region. The third leg 43 also includes a tip hole to discharge some of the cooling air through the blade tip in this region as represented by the arrow in FIG. 6.

Figure 7:
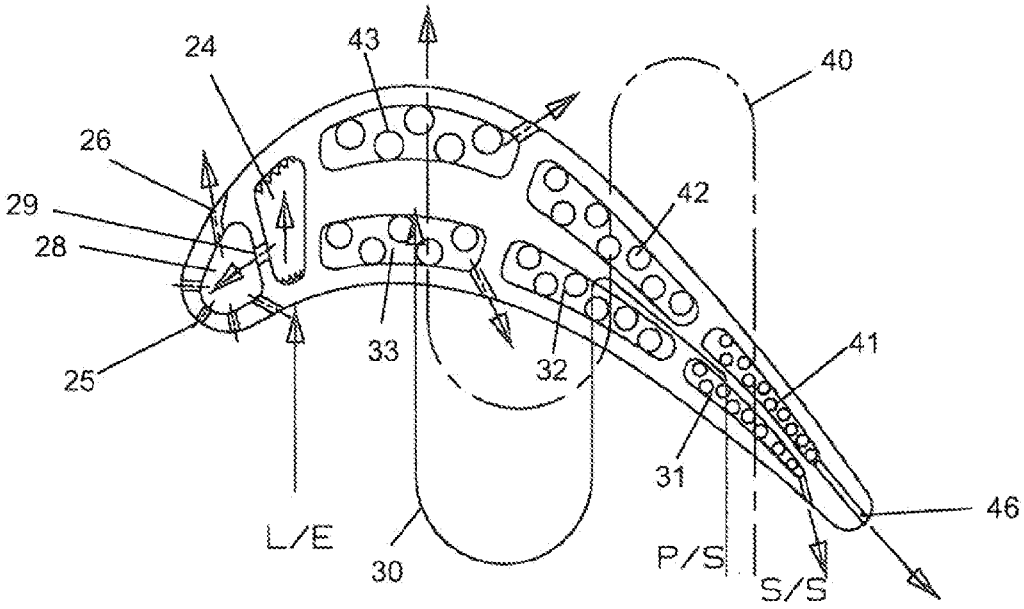
FIG. 7 shows a cross section view of a second embodiment of the dual triple pass serpentine flow cooling circuit of the present invention.

A second embodiment of the dual triple pass serpentine flow cooling circuit is shown in FIG. 7 in which tow forward flowing serpentine circuits are used. A first forward flowing serpentine circuit 30 is located along the pressure side wall and the second forward flowing serpentine 40 is located along the suction side wall. Both serpentine 30 and 40 include three legs 31-33 and 41-43 that are adjacent to one another and of the same chordwise length. All of the legs 31-33 and 41-43 include slanted ribs on both side walls of the channels that form a criss-cross flow path for the cooling air. In the second embodiment of FIG. 7, the leading edge region is cooled with a separate cooling circuit that includes a leading edge region cooling supply channel 24 connected by a row of metering and impingement holes 29 to a leading edge impingement channel 28 that is then connected to the showerhead film cooling holes 25 and gill holes 26. The leading edge region cooling circuit and the two triple-pass serpentine flow cooling circuits 30 and 40 are separate cooling circuits that are not connected to one another. One or more rows of film cooling air can be located on the PS or the S/S walls to discharge cooling air from a channel of the serpentine flow circuit to provide a layer of film cooling air to needed surfaces of the blade.

In the second embodiment of FIG. 7, the row of trailing edge exit holes 46 is connected to the first leg 41 of the second serpentine 40 circuit located along the suction side wall. A row of pressure side film cooling holes is located along the trailing edge region and is connected to the first leg 31 of the first serpentine 30 located along the pressure side wall. A row of film cooling holes is located on the pressure side wall and is connected to the third leg 33 of the first serpentine circuit 30. A row of film cooling holes is located on the suction side wall and is connected to the third leg 43 of the second serpentine circuit 40.

Figure 8:
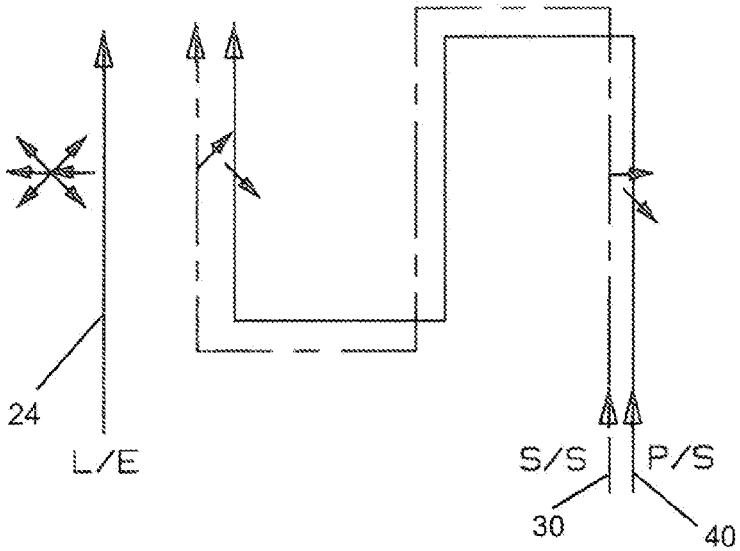
FIG. 8 shows a flow diagram of the cooling circuit of FIG. 7.

A flow diagram of the cooling circuit of FIG. 7 is shown in FIG. 8 and operates as follows. Cooling air is supplied to both serpentines 30 and 40 through the first legs 31 and 41 and flows upward toward the blade tip to cool the respective wall of the airfoil in this region. Some of the cooling air in the first leg 31 flows through the row of film cooling holes along the pressure side wall. Some of the cooling air in the first leg 41 flows through the trailing edge exit holes 46 to provide cooling for the trailing edge. Cooling air from the first leg 31 turns and flows into the second leg 32 to provide impingement cooling to the tip floor, and then flows into the third leg 33 where most of the cooling air flows through the film cooling holes on the pressure side wall with the remaining cooling air flowing through the tip cooling hole to provide cooling to the blade tip. The cooling air from the first leg 41 turns into the second leg and provide impingement cooling to the tip floor. The cooling air then flows into the third leg 43 where most is discharged through the film cooling holes on the suction side wall. The remaining cooling air flows through the tip hole to provide cooling to the blade tip.

Figure 9:
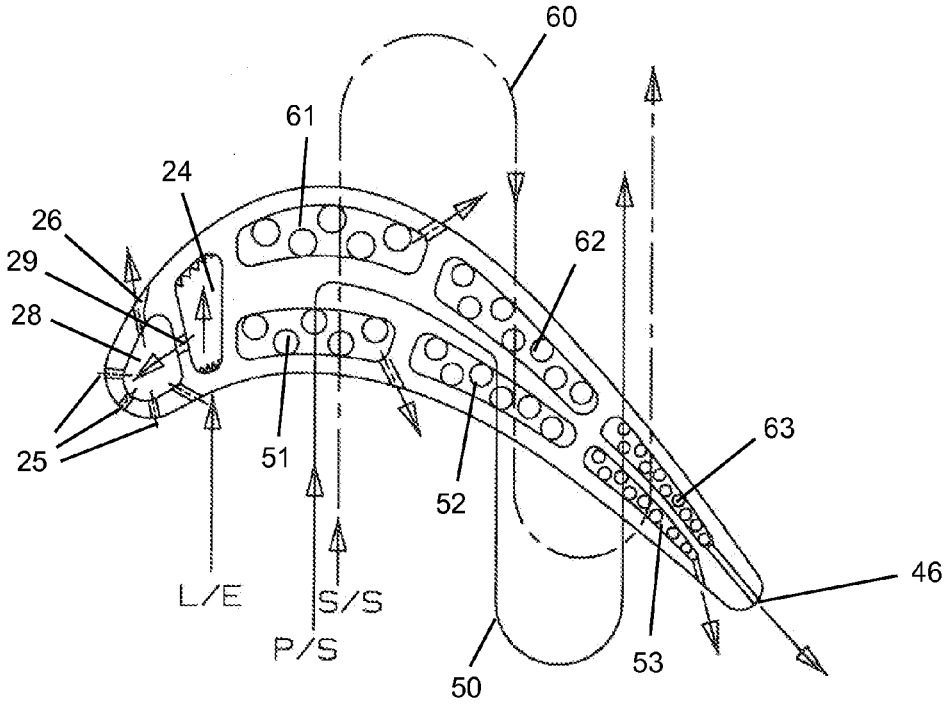
FIG. 9 shows a cross section view of a third embodiment of the dual triple pass serpentine flow cooling circuit of the present invention.
Figure 10:
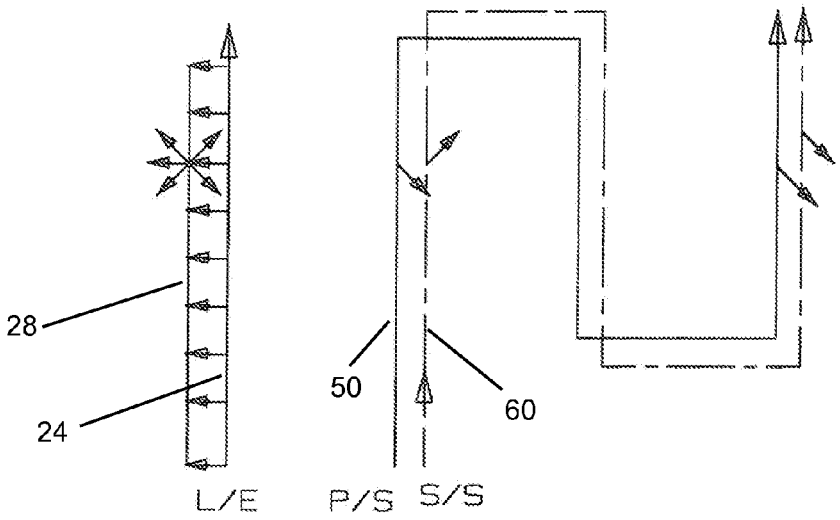
FIG. 10 shows a flow diagram of the cooling circuit of FIG. 9.

A third embodiment is shown in FIG. 9 and includes two aft flowing triple pass serpentine circuits 50 and 60 with the first serpentine circuit 50 located along the pressure side wall and the second serpentine circuit 60 located along the suction side wall. The first legs 51 and 61 are located adjacent to the leading edge region with the second legs 52 and 62 and the third legs 53 and 63 occupying the remaining portions of the airfoil and ending at the trailing edge region. The row of trailing edge exit holes 26 is connected to the third leg 63 of the second serpentine circuit 60. The row of film cooling holes on the pressure side wall is connected to the third leg 53 of the first serpentine circuit 50. As in the FIGS. 6 and 7 embodiment, the FIG. 9 embodiment includes a separate cooling circuit for the leading edge region with a leading edge cooling supply channel 24 connected by a row of metering holes 29 to the leading edge impingement channel 28 that is then connected to the showerhead arrangement of film cooling holes 25 and gill holes 26 along the pressure side and suction side walls. Both of the third legs 53 and 63 are connected to tip cooling holes to discharge cooling air through the tip floor. All of the legs 51-53 and 61-63 of the two serpentine flow circuits are formed by an arrangement of slanted robs on the P/S and S/S walls of each channel in which the two sets of slanted ribs form a criss-cross flow path for the cooling air.

In each of the three embodiments of FIGS. 5, 7, and 9, the airfoil is cooled with a leading edge impingement channel 28, a leading edge cooling air supply channel (labeled 33 in FIG. 5), two cooling channels (31 and 32 in FIG. 5) located along the pressure side wall and extending along the mid-airfoil section, two cooling channels (41 and 42 in FIG. 5) located along the suction side wall and extending along the mid-airfoil section, and either a single trailing edge cooling channel (43 in FIG. 5) or two cooling channels (31 and 41 in FIGS. 7 and 9). A row of exit holes 46 connected to one of the channels is used in each of the three embodiments. Each different embodiment of FIGS. 5, 7 and 9 passes the cooling air through these commonly positioned channels in a different path. For example, the leading edge cooling air channel 33 in FIG. 5 is the third leg of the forward flowing serpentine circuit along the pressure side wall. In the FIGS. 7 and 9 embodiments, the same cooling channel is a separate cooling air supply channel from the dual triple pass serpentine circuits. In FIG. 5, the trailing edge cooling channel means is a single channel 43 that extends across both pressure and suction side walls, while in FIGS. 7 and 9 the trailing edge cooling channel means is formed by the two channels 31 and 41 or 53 and 63 that together extend across the pressure and suction side walls.

Figure 13:
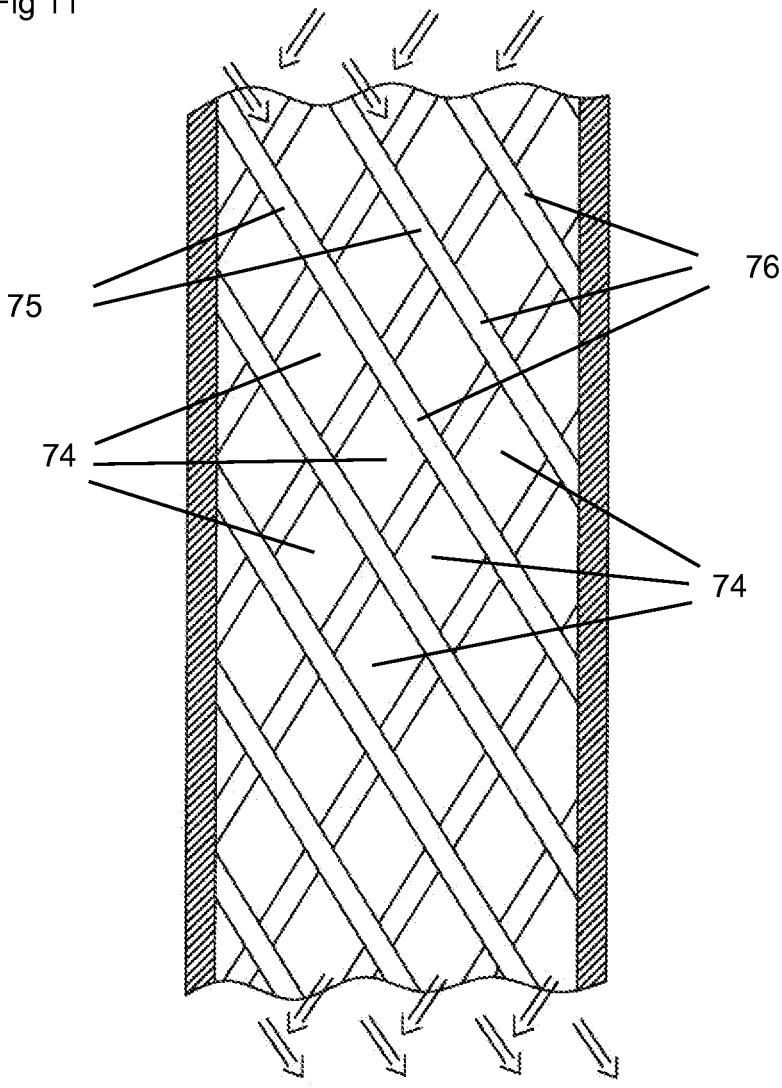
FIG. 13 shows a cross section side view of the slanted ribs that form the criss-cross flow path in the serpentine flow channels.

FIG. 13 shows a side view of one of the channels of the serpentine flow circuits used in the various embodiments of the present invention. The channel is formed between two ribs that extend from a P/S wall to a S/S wall of the airfoil and includes a first row of slanted ribs 75 that are slanted toward the L/E and a second row of slanted ribs 76 that are slanted toward the T/E of the blade. The first row of slanted ribs is located on one side of the channel while the second row of slanted ribs 76 is located on the opposite wall of the channel. The first row of slanted ribs 75 form a first row of slanted passages formed between adjacent ribs, while the second row of slanted ribs 76 form a second row of slanted passages. Cooling air flows along these slanted passages and mixes within the diamond shaped mixing chambers 74 formed by the slanted ribs to produce a criss-cross flow for the cooling air that produces an improved heat transfer coefficient that the cited prior art. The slanted ribs 75 and 76 can be formed in the blade during the investment casting process that forms the blade and the internal cooling circuits. The slanted ribs are offset at around 45 degrees but could be at a different angle.

Figure 11:
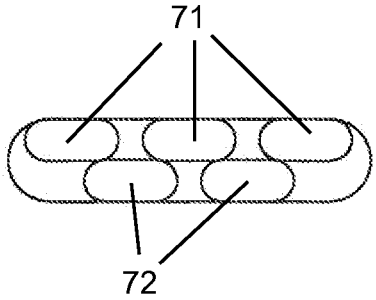
FIG. 11 shows a cross section view in a spanwise direction of the blade with a first embodiment of the slanted ribs that form a criss-cross flow path in the serpentine flow channels.

FIG. 11 shows a first embodiment of the slanted ribs and slanted passages formed within the cooling channels. The slanted ribs from both sides of the channel extend about half way such that they abut each other. The slanted passages 71 and 72 have an elliptical cross sectional shape as seen in FIG. 11 in which the slanted ribs have concave shaped sides. However, the ribs and the resulting passages can have other configurations.

Figure 12:
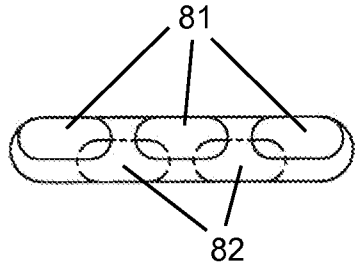
FIG. 12 shows a cross section view in a spanwise direction of the blade with a second embodiment of the slanted ribs that form a criss-cross flow path in the serpentine flow channels.

FIG. 12 shows a second embodiment of the slanted ribs and slanted passages formed within the cooling channels. The slanted ribs extend beyond the half way point to form the slanted channels 81 and 82. The diamond shaped mixing chambers 74 are also formed by the slanted ribs 81 and 82 of the FIG. 12 embodiment.

The three embodiments of the dual triple pass serpentine flow cooling circuit of the present invention will maximize the airfoil rotational effects on the internal heat transfer coefficient. Manufacturability can be enhanced due to the high aspect ratio cavity geometry. This design achieves a better airfoil internal cooling heat transfer coefficient for a given cooling air supply pressure and flow level. The channels of the two serpentine flow circuits are formed by an arrangement of slanted robs on the P/S and S/S walls of each channel in which the two sets of slanted ribs form a criss-cross flow path for the cooling air. The blade with the cooling circuits of the present invention will maximize the airfoil rotational effects on the internal heat transfer coefficient to achieve a better airfoil internal cooling heat transfer coefficient for a given cooling air supply pressure and flow level. For these serpentine flow cooling circuits, the criss-cross flow paths formed within the channels incorporated into the high aspect ration cooling channels with further increase the internal cooling performance and conduct heat from the airfoil external walls to the serpentine flow channels to achieve a more thermally balanced cooling design. A lower airfoil mass average sectional metal temperature and a higher stress rupture life are produced. The criss-cross flow channels within the serpentine cooling circuits for both sides of the airfoil will yield a multiple layer cooling formation.

I claim the following:

1. An air cooled turbine rotor blade comprising:

an airfoil with a leading edge and a trailing edge and a pressure side wall and a suction side wall extending between the two edges;

a leading edge impingement channel located along the leading edge of the airfoil;

a row of trailing edge exit holes located in a trailing edge region of the airfoil;

a first triple pass serpentine flow cooling circuit having a forward flowing direction and first and second legs located along the pressure side wall and in the mid-airfoil region with a third leg located in the leading edge region;

a second triple pass serpentine flow cooling circuit having an rearward flowing direction and first and second legs located along the suction side wall and in the mid-airfoil region with a third leg located in the trailing edge region;

a showerhead arrangement of film cooling holes on the leading edge of the airfoil and being connected to the third leg of the first triple pass serpentine flow cooling circuit; and a row of trailing edge exit holes connected to the third leg of the second triple pass serpentine flow cooling circuit.

2. The air cooled turbine rotor blade of claim 1, and further comprising:

the third legs of the first and second triple pass serpentine flow cooling circuits both extend across the airfoil from the pressure side wall to the suction side wall.

3. The air cooled turbine rotor blade of claim 1, and further comprising:

the first and second legs of both triple pass serpentine flow cooling circuits extend from the leading edge region to the trailing edge region to provide near wall cooling along mid-airfoil region.

4. The air cooled turbine rotor blade of claim 1, and further comprising:

the first and second triple pass serpentine flow cooling circuits are both without any film cooling holes.

5. The air cooled turbine rotor blade of claim 1, and further comprising:

the first leg of the first serpentine circuit and the second leg of the second serpentine circuit have about the same chordwise length; and, the second leg of the first serpentine circuit and the first leg of the second serpentine circuit have about the same chordwise length.

6. The air cooled turbine rotor blade of claim 1, and further comprising:

the legs of the serpentine flow cooling circuits have slanted ribs that form diamond shaped mixing chambers such that a criss-cross flow path for the cooling air is formed; and, the slanted ribs from both sides of the channel each extend beyond the slanted ribs from opposite sides of the channel.

7. An air cooled turbine rotor blade comprising:

an airfoil having a leading edge and a trailing edge, and a pressure side wall and a suction side wall extending between the two edges;

a leading edge impingement channel located along the leading edge of the airfoil;

a showerhead arrangement of film cooling holes connected to the leading edge impingement channel;

a leading edge cooling channel located adjacent to the leading edge impingement channel, the leading edge cooling channel extending between the pressure side wall and the suction side wall of the airfoil;

a row of metering and impingement holes to connect the leading edge impingement channel to the leading edge cooling channel;

a trailing edge cooling channel means located along the trailing edge region of the airfoil and extending from the pressure side wall to the suction side wall;

a row of trailing edge exit holes connected to the trailing edge cooling channel means;

a forward pressure side cooling air channel and a rearward pressure side cooling air channel;

a forward suction side cooling air channel and a rearward suction side cooling air channel;

the forward and rearward cooling air channels extending from the leading edge cooling channel to the trailing edge cooling channel means; and, the cooling channels forming a dual triple pass serpentine flow cooling circuit for the airfoil.

8. The air cooled turbine rotor blade of claim 7, and further comprising:

the trailing edge cooling channel means is formed as a single trailing edge cooling channel that extends across the pressure side and suction side walls and is connected to the row of trailing edge exit holes; and, the single trailing edge cooling channels forms a third leg of a second triple pass serpentine flow circuit with the two cooling channels located along the suction side wall.

9. The air cooled turbine rotor blade of claim 7, and further comprising:

the trailing edge cooling channel means is formed as a pressure side trailing edge cooling channel and a suction side trailing edge cooling channel both with about the same chordwise length; and, the suction side trailing edge cooling channel is connected to the row of trailing edge exit holes.

10. The air cooled turbine rotor blade of claim 9, and further comprising:

the pressure side trailing edge cooling channel forms a first leg of a first triple pass serpentine flow circuit with the two pressure side cooling air channels;

the suction side trailing edge cooling channel forms a first leg of a second triple pass serpentine flow circuit with the two suction side cooling air channels.

11. The air cooled turbine rotor blade of claim 9, and further comprising:

the pressure side trailing edge cooling channel forms a third leg of a first triple pass serpentine flow circuit with the two pressure side cooling air channels;

the suction side trailing edge cooling channel forms a third leg of a second triple pass serpentine flow circuit with the two suction side cooling air channels.

12. The air cooled turbine rotor blade of claim 9, and further comprising:

the leading edge cooling channel is a cooling air supply channel separate from the pressure side and suction side cooling channels.

13. The air cooled turbine rotor blade of claim 7, and further comprising:

the pressure side and the suction side cooling channels and the trailing edge cooling channel means and the leading edge cooling channel all extend a spanwise length of the airfoil from a platform to a blade tip.

14. The air cooled turbine rotor blade of claim 7, and further comprising:

the legs of the serpentine flow cooling circuits have slanted ribs that form diamond shaped mixing chambers such that a criss-cross flow path for the cooling air is formed; and, the slanted ribs from both sides of the channel each extend beyond the slanted ribs from opposite sides of the channel.

15. An air cooled turbine rotor blade comprising:

a leading edge region and a trailing edge region;

a pressure side wall and a suction side wall extending between the leading edge region and the trailing edge region;

a first serpentine flow cooling circuit located along the pressure side wall;

a second serpentine flow cooling circuit located along the suction side wall;

the legs of the two serpentine flow cooling circuits have slanted ribs that form diamond shaped mixing chambers such that a criss-cross flow path for the cooling air is formed; and, the slanted ribs from both sides of the channel each extend beyond the slanted ribs from opposite sides of the channel.

16. The air cooled turbine rotor blade of claim 15, and further comprising:

the first and second serpentine flow cooling circuits are both triple-pass serpentine flow circuits.

17. The air cooled turbine rotor blade of claim 16, and further comprising:

the first serpentine flow cooling circuit is forward flowing; and, the second serpentine flow cooling circuit is aft flowing.

18. The air cooled turbine rotor blade of claim 16, and further comprising:

the first and second serpentine flow cooling circuits are both forward flowing.

19. The air cooled turbine rotor blade of claim 16, and further comprising:

the first and second serpentine flow cooling circuits are both aft flowing.

20. An air cooled turbine airfoil comprising:

a pressure side wall and a suction side wall;

a radial extending cooling air channel having a first wall closer to the pressure side wall and a second wall closer to the suction side wall;

the first wall having a series of slanted ribs extending into the radial extending cooling channel;

the second wall having a series of slanted ribs extending into the radial extending cooling channel;

the first and second series of slanted ribs form diamond shaped mixing chambers such that a criss-cross flow path for the cooling air is formed; and, the slanted ribs from both sides of the channel each extend beyond the slanted ribs from opposite sides of the channel.

21. The air cooled turbine airfoil of claim 20, and further comprising:

the slanted ribs are offset at 45 degrees.

22. The air cooled turbine airfoil of claim 20, and further comprising:

the first series of slanted ribs abut the second series of slanted ribs.

* * * * *